US012571575B2

(12) United States Patent
Oshima

(10) Patent No.: US 12,571,575 B2
(45) Date of Patent: Mar. 10, 2026

(54) ICE MAKING DEVICE

(71) Applicant: NIDEC INSTRUMENTS CORPORATION, Nagano (JP)

(72) Inventor: Yuta Oshima, Nagano (JP)

(73) Assignee: NIDEC INSTRUMENTS CORPORATION, Nagano (JP)

( * ) Notice: Subject to any disclaimer, the term of this patent is extended or adjusted under 35 U.S.C. 154(b) by 200 days.

(21) Appl. No.: 18/352,260

(22) Filed: Jul. 14, 2023

(65) Prior Publication Data

US 2024/0027120 A1 Jan. 25, 2024

(30) Foreign Application Priority Data

Jul. 20, 2022 (JP) ..... 2022-115315

(51) Int. Cl.
*F25C 5/06* (2006.01)
*F25C 1/243* (2018.01)

(52) U.S. Cl.
CPC ..... *F25C 5/06* (2013.01); *F25C 1/243* (2013.01); *F25C 2305/022* (2013.01); *F25C 2700/02* (2013.01); *F25C 2700/12* (2013.01)

(58) Field of Classification Search
CPC ..... F25C 5/06; F25C 1/243; F25C 2305/022; F25C 2700/02; F25C 2700/12; F25C 2600/04
See application file for complete search history.

(56) References Cited

U.S. PATENT DOCUMENTS 5,289,691 A * 3/1994 Schlosser ..... F25C 1/12 62/78
2015/0068224 A1* 3/2015 Subera ..... F25C 5/187 62/340
2019/0068032 A1 2/2019 Saito

FOREIGN PATENT DOCUMENTS

JP 2019045043 3/2019

* cited by examiner

*Primary Examiner* — Cassey D Bauer
(74) *Attorney, Agent, or Firm* — JCIPRNET

(57) ABSTRACT

An ice making device includes an ice making tray, an output part which is connected with the ice making tray and turns the ice making tray, a motor which is a drive source of the output part, a first board having a converter which converts alternating current to direct current, and a second board connected with a part which is operated by the direct current. The second board includes a control part which controls an operation of the ice making device, and the first board and the second board are connected with each other by inter-board connectors.

10 Claims, 14 Drawing Sheets

ICE MAKING DEVICE

CROSS REFERENCE TO RELATED APPLICATION

The present invention claims priority under 35 U.S.C. § 119 to Japanese Application No. 2022-115315 filed Jul. 20, 2022, the entire content of which is incorporated herein by reference.

TECHNICAL FIELD

At least an embodiment of the present invention may relate to an ice making device and, more specifically, relate to an automatic ice making device including a control part.

BACKGROUND

In Japanese Patent Laid-Open No. 2019-45043, an automatic ice making device is disclosed which includes a first circuit board having an AC/DC converter, a second circuit board for control, and a motor board.

In a case that a plurality of boards disposed within a narrow and small case is connected with each other by soldering of lead wires or terminals, difficulty of the soldering may deteriorate workability of assembling work and connection accuracy between the boards. Further, in a case that lead wires are used for the connection, an extra space for moderately loosening the lead wires is required and thus, a size of the device is increased.

SUMMARY

At least an embodiment of the present invention may advantageously provide an ice making device whose structure is improved and assemblability is enhanced.

According to at least an embodiment of the present invention, there may be provided an ice making device including an ice making tray, an output part which is connected with the ice making tray and turns the ice making tray, a motor which is a drive source of the output part, a first board having a converter which converts alternating current (AC) to direct current (DC), and a second board connected with a part which is operated by the direct current. The second board has a control part which controls an operation of the ice making device, and the first board and the second board are connected with each other by inter-board connectors.

When a plurality of boards is fittingly connected (structurally connected) by using inter-board connectors, connection work of the boards is easily performed and connection accuracy is uniformed. Further, when a board is divided into a plurality of boards based on types of input currents, functions and the like of parts mounted on the board, the respective boards can be flexibly arranged at optimum positions and a structure of the ice making device is simplified.

In this case, according to an embodiment, the inter-board connectors vertically connect the first board with the second board. When the first board and the second board are vertically connected with each other, a maximum size in a three-dimensional direction after connection can be made smaller than a maximum size of the two boards which are connected on the same plane. As a result, the board is prevented from becoming a bottleneck for miniaturization.

Further, in this case, according to an embodiment, no lead wire is used for connection of the first board with the second board. According to this structure, an arrangement space of a lead wire is eliminated and a size of the ice making device can be further reduced.

Further, in the ice making device in accordance with an embodiment of the present invention, the motor is a direct current (DC) motor, and the second board has a drive circuit for the motor. When a DC motor is adopted as a drive source, drive and control of the motor, in other words, operation control of the ice making device is easily performed and an operation of the ice making device is stable.

Further, it may be structured that the ice making device in accordance with an embodiment of the present invention includes an ice detection member which is lowered to an inside of an ice storage part where ice pieces discharged from the ice making tray are stored and detects an ice amount in an inside of the ice storage part, and the second board is connected with a switch or a sensor which detects a lowering amount of the ice detection member. Similarly, it may be structured that the ice making device in accordance with an embodiment of the present invention includes a temperature sensor which detects a temperature of water stored in the ice making tray, and the temperature sensor is connected with the second board. When parts relating to an operation of the ice making device are gathered to the second board, the first board and the second board can be further reasonably divided.

Further, in the ice making device in accordance with an embodiment of the present invention, the first board may include a relay which opens and closes a water supply valve for supplying water to the ice making tray. When a relay which commonly has a mechanical contact is mounted on the first board, a problem such as noise or a spark can be gathered to the first board. Further, the second board controls electric and electronic components by receiving supply of DC power from the first board and thus, the second board is usually arranged in an inner and back portion of the device with respect to the first board. Therefore, when the relay which is connected with a mechanical element (water supply valve in an embodiment of the present invention) provided on an outer side of the device is disposed on the first board instead of the second board, the relay and the water supply valve are easily accessed.

Further, in the ice making device in accordance with an embodiment of the present invention, the first board has a varistor. When the first board is provided with a detouring function of a surge current, a power supply function of the ice making device is gathered to the first board. As a result, safety of the second board is secured and a configuration of the second board can be simplified.

Further, the ice making device in accordance with an embodiment of the present invention includes a case body which accommodates the first board and the second board, the case body includes a first space which is a space where the first board is accommodated and a second space which is a space where the second board is accommodated in its inside, the first space and the second space are sectioned by a partition, and the partition is provided with an opening part for connecting the inter-board connectors with each other. When the space where the first board is disposed and the space where the second board is disposed are sectioned by a partition and, for example, when parts which affect a pass/fail result on a safety standard such as an insulation property or an explosion-proof property are gathered to the first board, the ice making device is capable of being flexibly adapted to various standards by devising a structure of the first space.

In this case, according to an embodiment, the case body includes a frame part which turnably supports the ice making tray and a box part which accommodates the first board and the second board, the box part includes an inner case which is a half case body having no cover in an inside of the box part, the inner case is fixed to an inner face of the box part in a state that an opening of the inner case is directed toward the inner face of the box part, and the partition is the inner case. According to this structure, the box part includes an inner case which is a separate member from the box part and thus, mechanical parts such as gears can be previously assembled in the inner case and they are collectively accommodated and fixed to the box part, and assemblability of the ice making device is enhanced. Further, the inner case is also used as a partition and thus, structural efficiency of the ice making device is enhanced.

Further, in this case, according to an embodiment, the box part includes a cover part which is capable of being attached and detached, the second board is connected with a main switch which is a switch for starting the ice making device, and each of the inner case and the cover part is provided with a hole through which the main switch is capable of being accessed from the outside of the cover part. When a main switch is provided on the second board having the control part and is structured to be capable of being accessed from the outside, an explosion-proof property is secured while a general switch part is used. In other words, in comparison with a structure that a power line is directly connected or disconnected by a switch, safety and a procurement risk of parts can be improved.

Effects of the Invention

As described above, according to the ice making device in the present invention, a structure of the ice making device is improved and its assemblability is enhanced.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

An ice making device in accordance with an embodiment of the present invention will be described below with reference to the accompanying drawings. An ice making device 90 described below is a device which is installed in a freezer chamber of a refrigerator not shown and to which water is supplied from the refrigerator to automatically make ice pieces.

An "upper and lower" direction in the following descriptions is a direction parallel to the "Z"-axis of coordinate axes described in FIG. 1, and the "Z1" side is an "upper" side and the "Z2" side is a "lower" side. A "front and rear" direction is a direction parallel to the "X"-axis of the coordinate axes, and the "X1" side is a "front" side and the "X2" side is a "rear" side. Similarly, a "right and left" direction is a direction parallel to the "Y"-axis of the coordinate axes, and the "Y1" side is a "right" side and the "Y2" side is a "left" side.

(Entire Structure)

Figure 1:
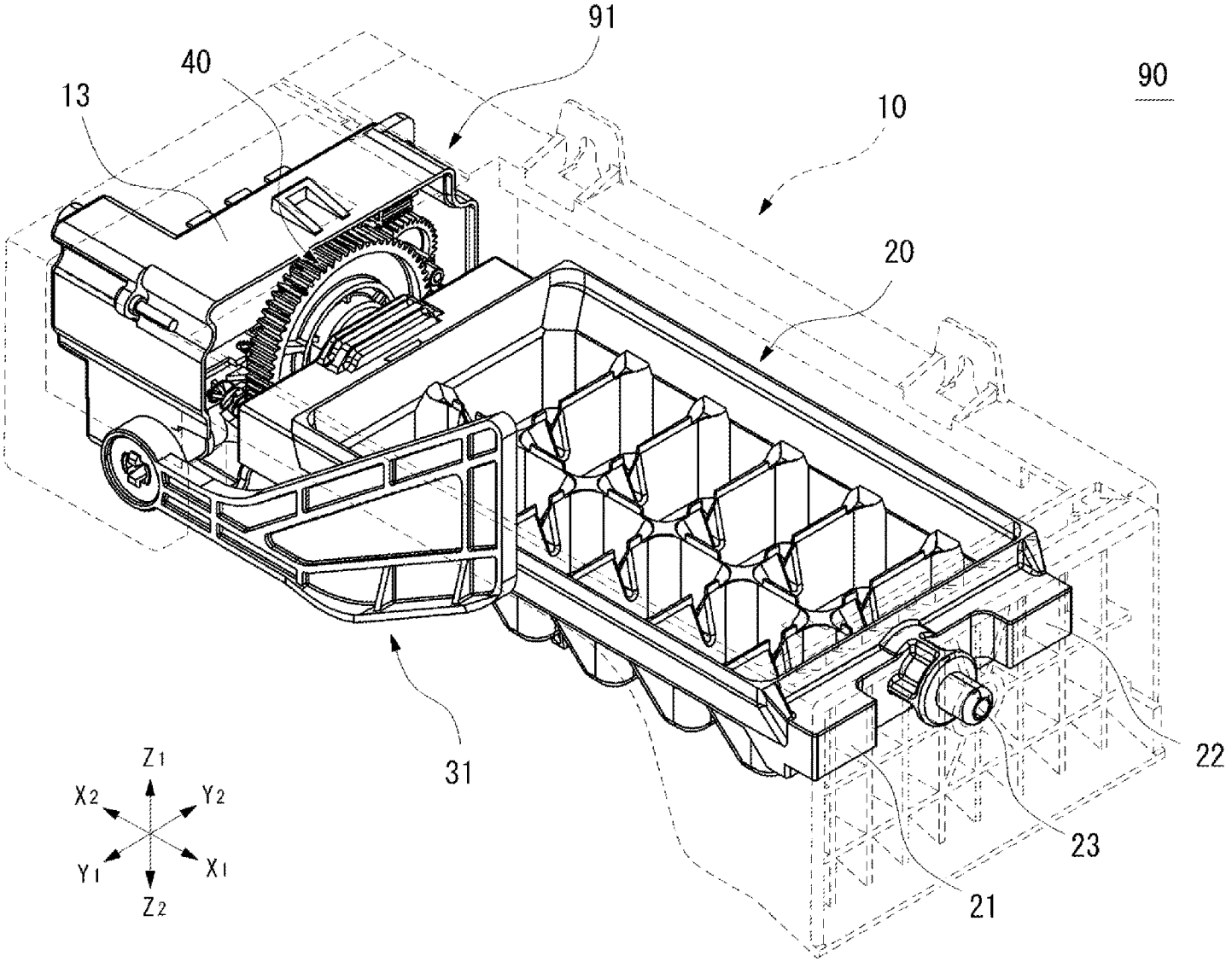
FIG. 1 is a perspective view showing an outward appearance of an ice making device in accordance with an embodiment of the present invention.

FIG. 1 is a perspective view showing an outward appearance of an ice making device 90. The ice making device 90 is a so-called twist type ice making device which is structured to discharge ice pieces by twisting an ice making tray 20. The ice making device 90 includes an ice making tray 20 made of resin which is provided with a plurality of cells (water storing compartment) and a drive unit 91 which is a motor unit for turning the ice making tray 20. The drive unit 91 and the ice making tray 20 are accommodated and supported by a case body 10 which is installed in a freezing chamber. Further, the drive unit 91 includes an ice detection lever 31 which is an ice detection member for detecting an amount of ice pieces in an ice storage part 92 described below.

(Schematic Ice Separating Operation)

Figure 2A:
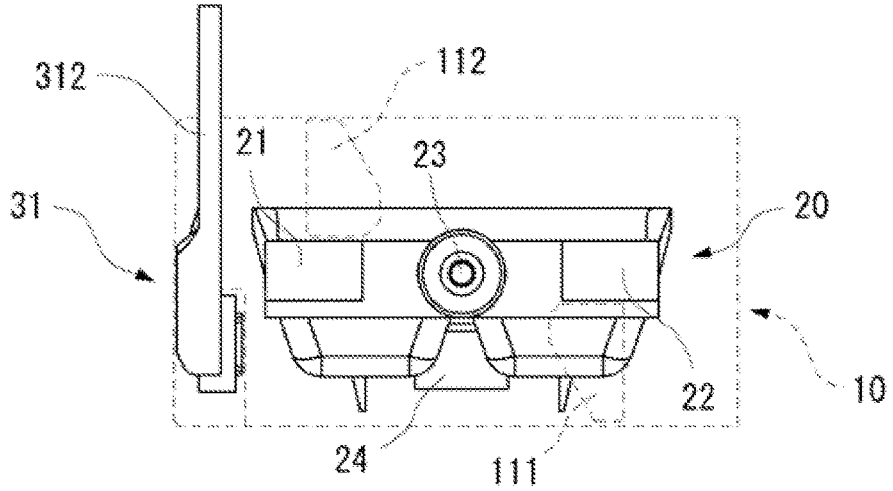
FIGS. 2A, 2B and 2C are schematic views showing a flow of an ice separating operation which is performed by an ice making device.
Figure 2B:
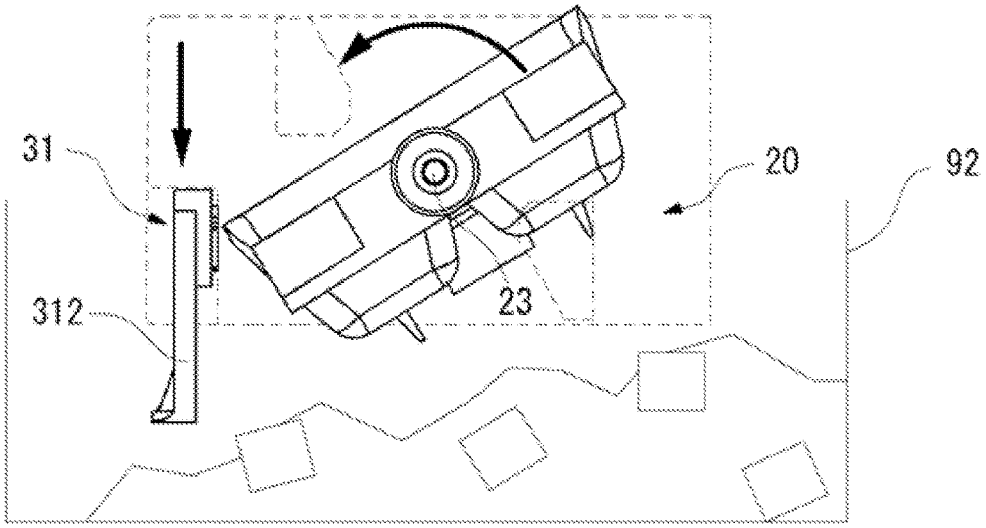
Figure 2C:
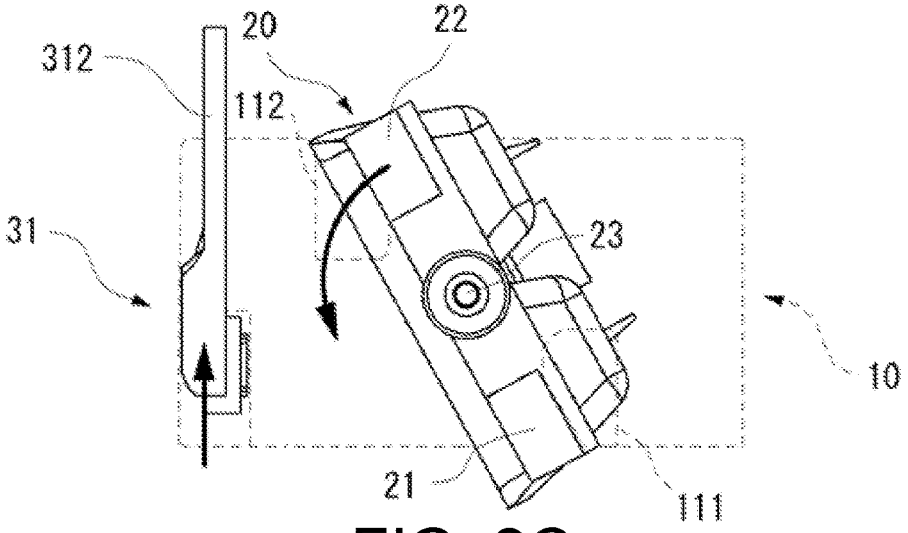

FIGS. 2A, 2B and 2C are schematic views showing a flow of an ice separating operation (operation for discharging ice pieces from the ice making tray 20) which is performed by the ice making device 90.

FIG. 2A is a view showing a state that the ice making tray 20 is located at an "ice making position" which is an arrangement angle where water is held. The ice making device 90 monitors a temperature of the ice making tray 20 by a thermistor 24 which is attached to its lower face and, when it is detected that the temperature of the ice making tray 20 has reached a predetermined value, an ice separating operation is started. FIGS. 2B and 2C are views showing the ice separating operation performed by the ice making device 90.

FIG. 2B is a view showing an "ice detection operation" which is a part of the ice separating operation. The "ice detection operation" is an operation in which an amount of ice pieces within the ice storage part 92 which is a container where ice pieces are stored is measured to determine whether the ice separating operation is continued or interrupted (canceled) When the ice separating operation is started and the ice making tray 20 starts turning in the "CCW" direction in the drawing, an arm part 312 of the ice detection lever 31 is lowered to an inside of the ice storage part 92 interlocking with turning of the ice making tray 20. In this case, when the ice detection lever 31 is moved down lower than a predetermined reference level, it is determined that an amount of the ice pieces is insufficient and thus, the ice separating operation is continued. On the other hand, when the downward movement of the ice detection lever 31 is prevented by stored ice pieces before the ice detection lever 31 reaches the reference level, it is determined that an amount of the ice pieces in the ice storage part 92 is a full state and the ice separating operation is canceled.

FIG. 2C is a view showing a "discharge operation" which is a part of the ice separating operation. In a case that an amount of the ice pieces in the ice storage part 92 is insufficient, the ice making device 90 continues the ice separating operation. A front end of the ice making tray 20 is formed at its center with a shaft part 23 supported by a shaft hole of the case body 10, and a first protruded part 21 and a second protruded part 22 each of which is a protruded part protruded to a front side are formed on right and left sides with respect to the shaft part 23. The case body 10 is provided with a first contact part 111 and a second contact part 112 for preventing turning of the ice making tray 20 on a turning path of the first protruded part 21 and the second protruded part 22. When the ice making tray 20 is continuously turned in the "CCW" direction in the drawing, the first protruded part 21 and the second protruded part 22 of the ice making tray 20 are contacted with the first contact part 111 and the second contact part 112 of the case body 10. The drive unit 91 further turns the ice making tray 20 from this state by several tens degree in the "CCW" direction to twist the ice making tray 20. As a result, ice pieces in the ice making tray 20 are discharged to an inside of the ice storage part 92.

(Schematic Drive Mechanism)

Figure 3:
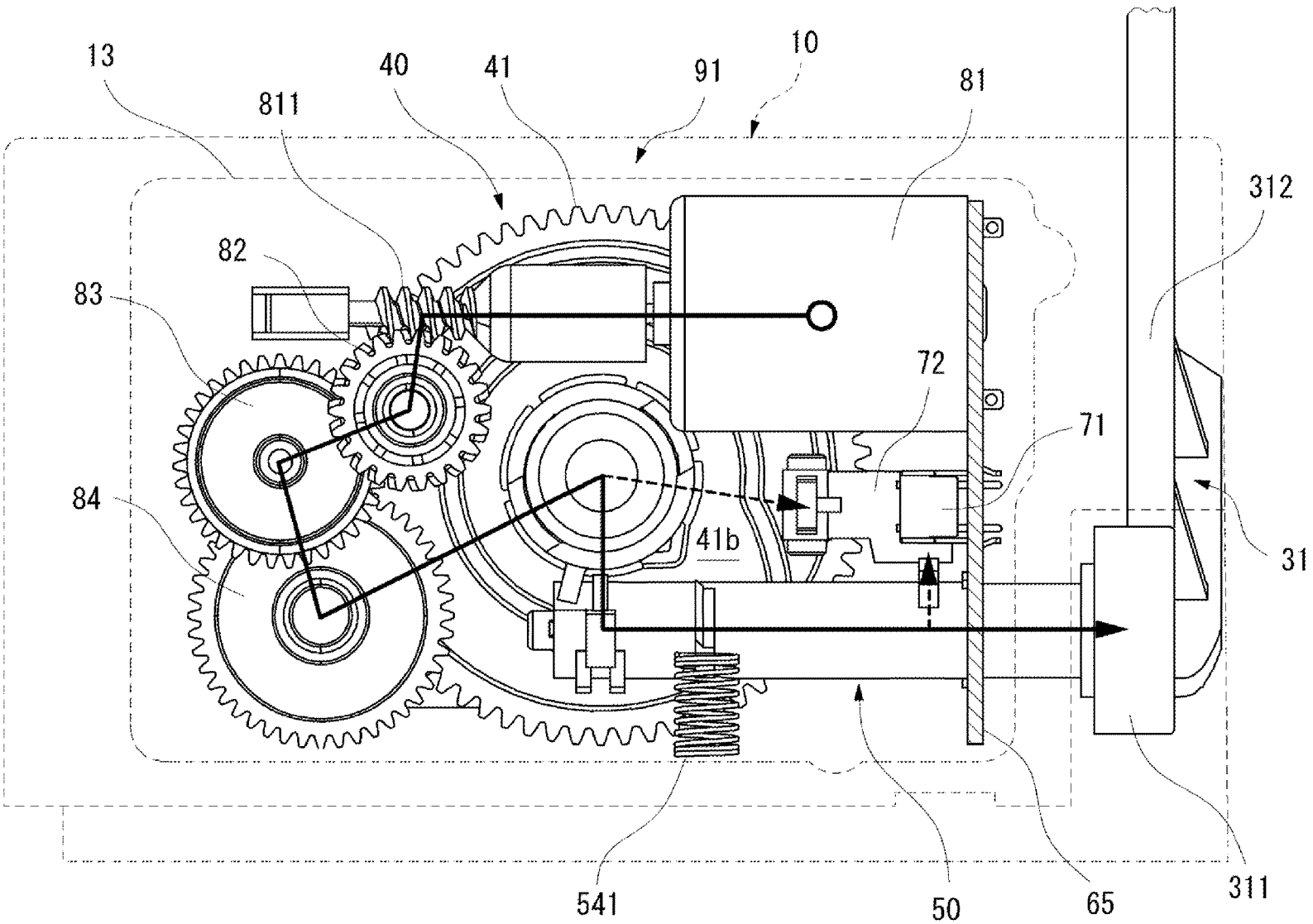
FIG. 3 is a rear view showing a power transmission path of a drive unit.

FIG. 3 is a rear view showing a power transmission path of the drive unit 91. The ice making device 90 receives electric power supply from the refrigerator in which the ice making device 90 is installed and performs various predetermined operations.

The drive unit 91 includes a DC (direct current) motor 81 (hereinafter, simply referred to as a "motor 81") which is a drive source, a cam gear 40 which is an output part for turning the ice making tray 20, and a driven shaft 50 for moving the ice detection lever 31 up and down interlocking with an operation of the cam gear 40.

The cam gear 40 is provided with a gear part 41 which is a circular plate part in a flange shape enlarged in a circular shape. A rear face 41*b* of the gear part 41 structures a driver part of a plane cam mechanism. The driven shaft 50 is a shaft body which structures a follower part for the gear part 41. The gear part 41 is formed with a teeth part on its outer peripheral face and functions as a spur gear. Rotation of the motor 81 is decelerated by a speed reduction gear train and is transmitted to the gear part 41 of the cam gear 40. The speed reduction gear train in this embodiment is structured of a worm gear 811 attached to an output shaft of the motor 81, a first gear 82, a second gear 83 and a third gear 84. Each of the first through third gears is a composite gear structured so that a large diameter gear and a small diameter gear are overlapped and integrated with each other in an axial line direction. A large diameter gear of the first gear 82 is a worm wheel which is paired with the worm gear 811.

Further, the rear face 41*b* of the gear part 41 is also contacted with a switch lever 72 which is another follower part. The switch lever 72 switches "ON" and "OFF" of an ice detection switch 71 which is a mechanical switch according to an arrangement (turning) angle of the cam gear 40 and an arrangement (turning) angle of the driven shaft 50 (in other words, moving-down angle of the ice detection lever 31). The ice making device 90 monitors an output of the ice detection switch 71 and, when an ice amount in a freezing chamber is sufficient (fully stored state with ice pieces), the ice separating operation performed by the drive unit 91 is canceled and, when the ice amount is insufficient, the ice separating operation is continued.

(Structure of Case Body)

Figure 4A:
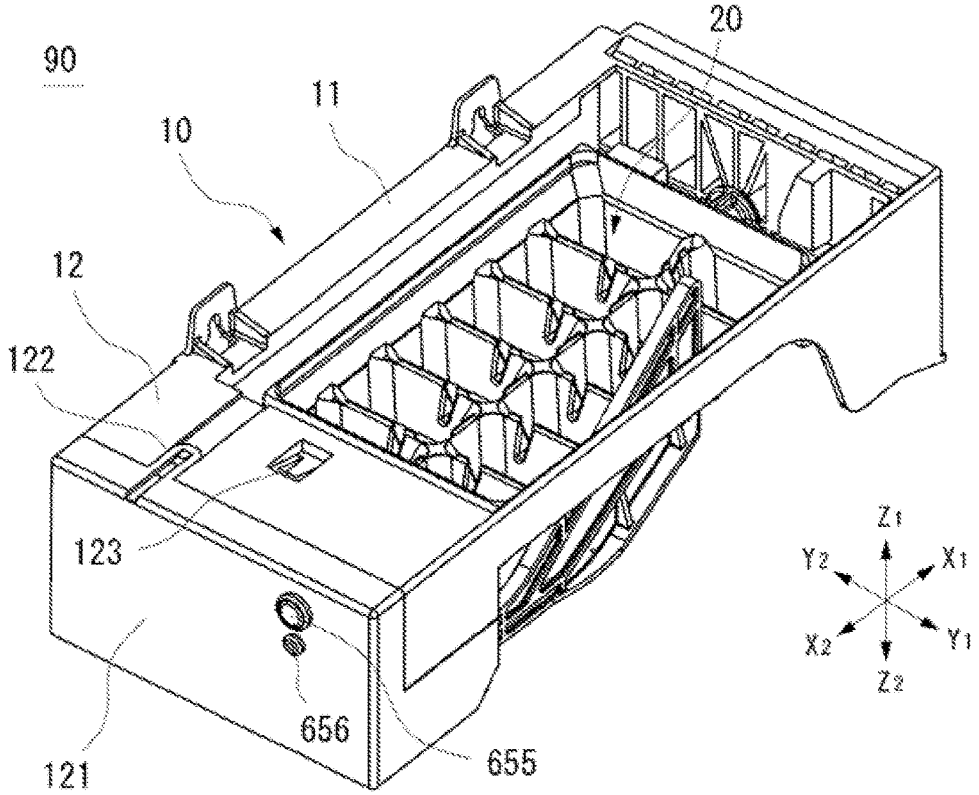
FIGS. 4A and 4B are perspective views showing a structure of a case body of an ice making device.
Figure 4B:
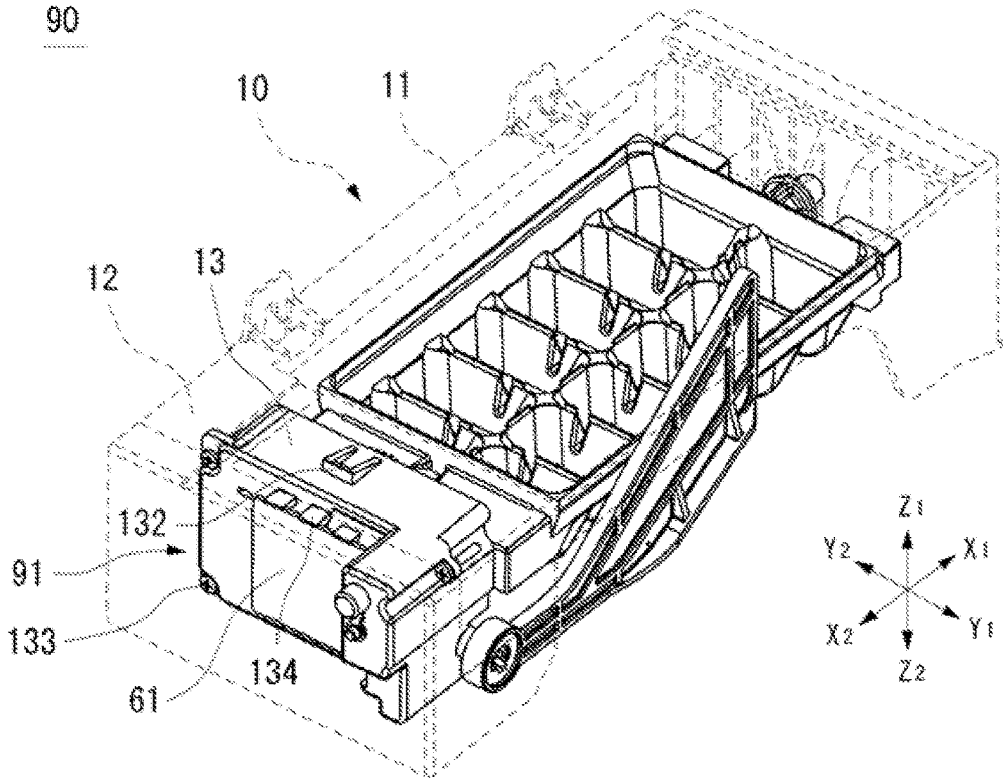

FIGS. 4A and 4B are perspective views showing a structure of the case body 10 of the ice making device 90. The case body 10 is a housing in a substantially rectangular parallelepiped shape as a whole. The case body 10 turnably supports the ice making tray 20 and accommodates the drive unit 91 in its inside.

The case body 10 is provided with a frame part 11 which holds the ice making tray 20 and a box part 12 which holds the drive unit 91. The frame part 11 is not provided with an upper face and a bottom face, and the entire ice making tray 20 is exposed to the outside. The substantially entire drive unit 91 is covered by the box part 12 except a connection part with the ice making tray 20. The box part 12 has a cover part 121 which is capable of being attached and detached by a hook 122. The hook 122 is also provided in a bottom face of the box part 12 and, when the hooks 122 are disengaged and the cover part 121 is opened, the inside of the box part 12 can be accessed. A rear face ("X2" side end face) of the case body 10, in other words, the cover part 121 is arranged with a main switch 655 which is a button for starting the ice making device 90 and a test switch 656 for confirming an operation of the ice making device 90 by a manufacturer or a service engineer.

An inner case 13 which is a half case body having no cover is fixed to the box part 12 by screws 133. The inner case 13 is provided with hooks 132 in a protruded shape on its upper face and lower face and, when the hooks 132 are engaged with hole parts 123 provided at corresponding positions in the box part 12, a position of the inner case 13 is temporarily fixed in the box part 12. The inner case 13 is fixed so that its opening is directed toward an inner face on a front side ("X1" side) of the box part 12. The inner case 13 is assembled with mechanical parts such as gears structuring the drive unit 91, a board 61 described below and the like. In the ice making device 90 in this embodiment, the box part 12 includes the inner case 13 which is a separate member from the box part 12 and thus, the parts structuring the drive unit 91 can be previously assembled in the inner case 13 and they are collectively accommodated and fixed to the box part 12. As a result, assemblability of the ice making device 90 is enhanced.

(Board Configuration)

Figure 5:
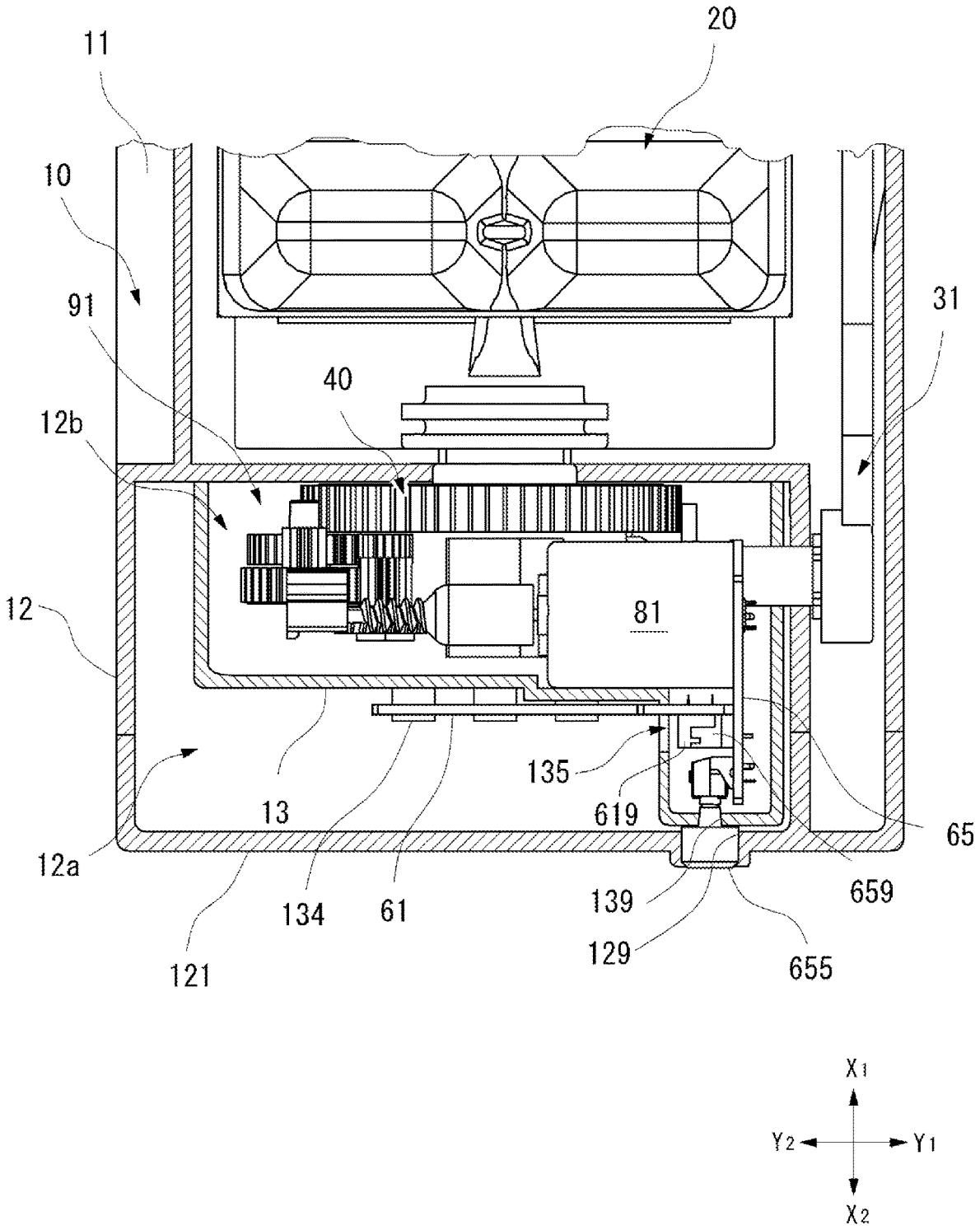
FIG. 5 is a plane transparent view showing arrangement of boards which are provided in a drive unit.
Figure 6:
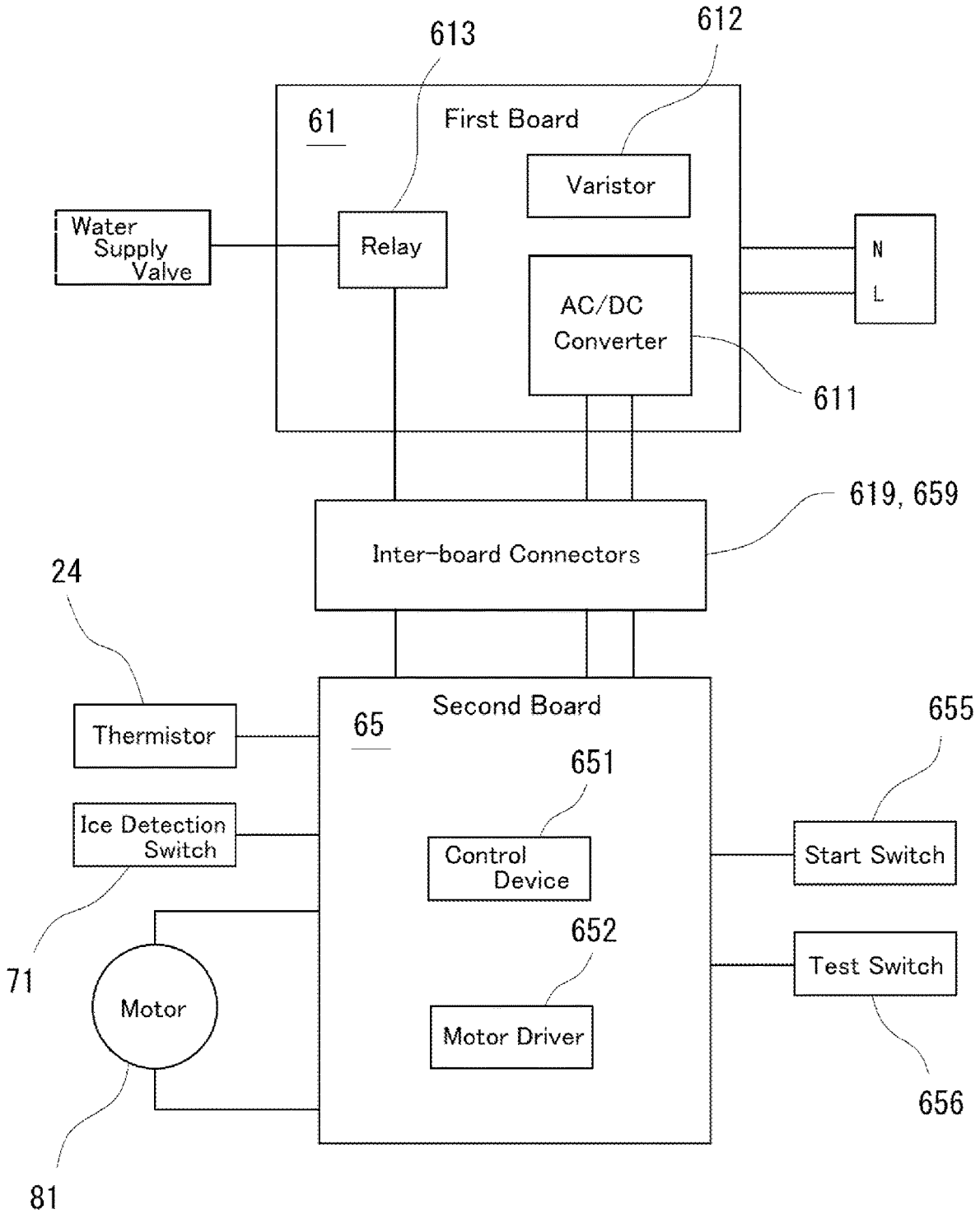
FIG. 6 is a block diagram showing functional configurations of boards.

FIG. 5 is a plane transparent view showing arrangement of boards which are provided in the drive unit 91. FIG. 6 is a block diagram showing functional configurations of the boards. A board configuration of the ice making device 90 will be described below with reference to FIGS. 5 and 6.

The ice making device 90 in this embodiment is a full-automatic ice making device which receives supply of electric power from a refrigerator that is a host apparatus to automatically perform water supply, ice making, ice discharging and control of ice storage amount. Further, the ice making device 90 includes a board for performing conversion of electric power and controlling of various operations.

The board of the ice making device 90 is structured of two rigid boards, i.e., a first board 61 and a second board 65. The first board 61 is a board having an AC/DC converter 611 which is a converter that converts AC power inputted from the refrigerator into DC power. The DC power is supplied from the first board 61 to the second board 65. The second board 65 is connected with electric and electronic components which are operated by DC power. Further, the second board includes a control device 651 which is a control part for controlling operations of the ice making device 90. A configuration of the control part is not limited. The control part in this embodiment of the present invention may be configured so as to be capable of receiving inputs from a sensor, switches and programs to arbitrarily perform switching of output signals, and the control part may be, for example, configured of a microcontroller, FPGA, CPLD, or other control circuits.

The first board 61 and the second board 65 are electrically connected with each other by inter-board connectors 619 and 659. In this embodiment, two boards are fitted and connected with each other by the inter-board connectors 619 and 659 and thus, the two boards are easily connected and connection accuracy is uniformed. Further, in this embodiment, the board is roughly divided into two boards based on types of input currents, functions and the like of parts mounted on the board and thus, the respective boards can be flexibly arranged at optimum positions. In addition, in the ice making device 90, lead wires are not used for connection of the first board 61 with the second board 65 and thus, an extra space for moderately loosening the lead wires is not required. As a result, structural efficiency of the ice making device 90 is enhanced.

Further, as shown in FIG. 5, the first board 61 and the second board 65 in this embodiment are vertically connected with each other (so that respective plane directions are intersected at an angle of 90°) by the inter-board connectors 619 and 659. When the first board 61 and the second board 65 are vertically connected with each other, a maximum size in a three-dimensional direction after connection is smaller than a maximum size of the two boards which are connected on the same plane. As a result, the boards are prevented from becoming a bottleneck for miniaturization.

As shown in FIG. 6, the first board 61 is mounted, in addition to the AC/DC converter 611, with a mechanical relay 613 (hereinafter, simply referred to as a "relay 613") for opening and closing a water supply valve which supplies water to the ice making tray 20. When the relay 613 having a mechanical contact is disposed on the first board 61, a problem such as noise or a spark is gathered to the first board 61. Further, although an operation of the relay 613 is controlled by the control device 651 on the second board 65, the second board 65 controls electric and electronic components by receiving supply of DC power from the first board 61 and thus, the second board 65 is arranged in an inner and back portion of the device with respect to the first board 61. Therefore, in this embodiment, the relay 613 which is connected with the water supply valve provided on the outside of the device is disposed on the first board 61 instead of the second board 65 and thus, the relay 613 and the water supply valve are easily accessed. In addition, a varistor 612 is also mounted on the first board 61. When the first board 61 is provided with a detouring function of a surge current, a power supply function of the ice making device 90 is gathered to the first board 61. As a result, safety of the second board 65 is secured and a configuration of the second board 65 is simple.

The second board 65 is connected with a motor 81, the above-mentioned main switch (start switch) 655 and test switch 656, a thermistor 24 and an ice detection switch 71. Further, the second board 65 is mounted with a motor driver 652 which is a drive circuit for the motor 81.

The ice making device 90 uses a DC motor 81 as its drive source. When a DC motor is adopted as a drive source, drive and control of the motor, in other words, operation control of the ice making device 90 is easily performed. As a result, a wide variety of functions and operations of the ice making device 90 is realized by a simple configuration. In addition, the second board 65 is connected with the thermistor 24 and the ice detection switch 71 (these specific functions are described below) and, as a result, parts relating to operation control of the ice making device 90 are gathered to the second board 65.

As described above, in the ice making device 90 in this embodiment, a function relating to a power supply is substantially gathered to the first board 61 and a function relating to operation control of the ice making device 90 is substantially gathered to the second board and thus, the board is rationally and flexibly divided into two portions.

As shown in FIG. 5, an inside space of the box part 12 which accommodates the first board 61 and the second board 65 is sectioned to a first space 12*a*, which is an outer side space with respect to the inner case 13, and a second space 12*b* which is an inner side space with respect to the inner case 13 with the inner case 13 as a partition. The second space 12*b* is sectioned by the inner case 13 and an inner face of the box part 12. The inside and the outside of the inner case 13 are communicated with each other only by an opening part 135 for connecting the inter-board connectors 619 and 659 with each other.

The first board 61 is held by a pawl 134 which is provided on a rear face of the inner case 13, in other words, the first board 61 is disposed in the first space 12*a*, and the second board 65 is accommodated in the inside of the inner case 13, in other words, the second board 65 is disposed in the second space 12*b*. Since the space where the first board 61 is disposed and the space where the second board 65 is disposed are sectioned by a partition, for example, parts which affect a pass/fail result on a safety standard such as an insulation property or an explosion-proof property can be gathered to the first board 61 and the ice making device 90 is capable of being flexibly adapted to various standards by devising a structure of the first space 12*a*. Further, in this embodiment, the inner case 13 also serves as a partition and thus, structural efficiency of the ice making device 90 is enhanced.

Further, in the ice making device 90 in this embodiment, the main switch 655 is connected with the second board 65 and the inner case 13 and the cover part 121 are respectively provided with button holes 129 and 139 so as to be capable of accessing the main switch 655 from the outside of the cover part 121. When the main switch 655 is provided on the second board 65 having the control device 651 and is structured to be capable of being accessed from the outside, an explosion-proof property is secured while a general switch part is used. In other words, in comparison with a structure that a power line is directly connected or disconnected by a switch, safety and a procurement risk of parts are improved.

(Detail of Drive Mechanism)

Details of respective parts which structure a drive mechanism of the drive unit 91 will be described below with reference to FIGS. 7A through 9B.

Figure 7A:
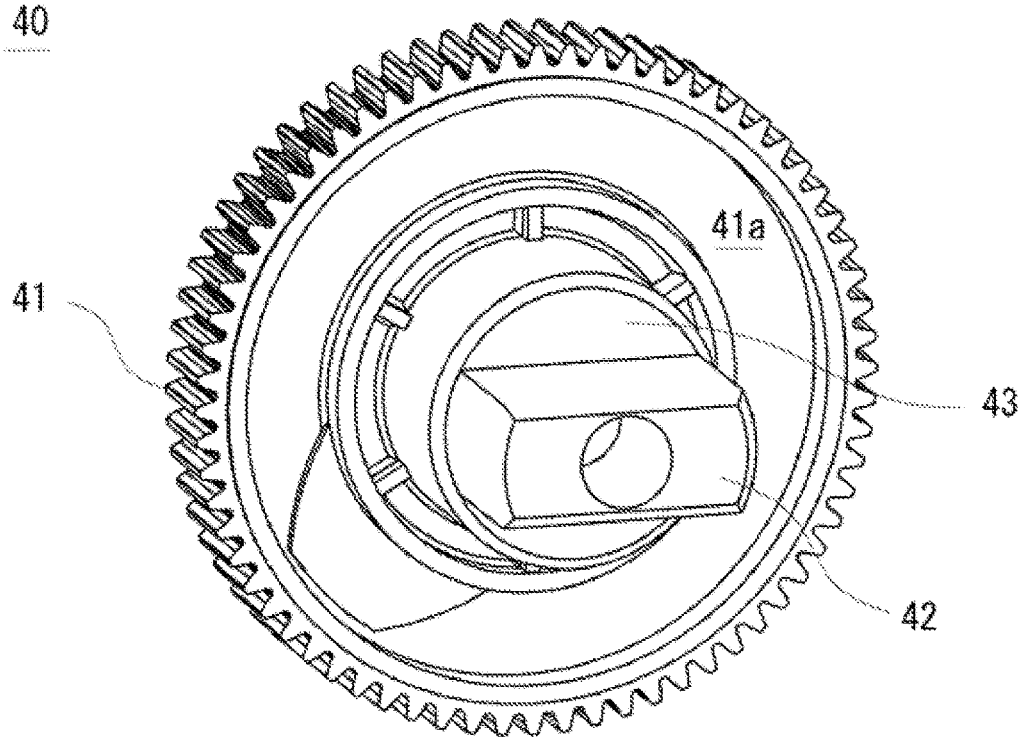
FIGS. 7A and 7B are perspective views showing a structure of a cam gear.
Figure 7B:
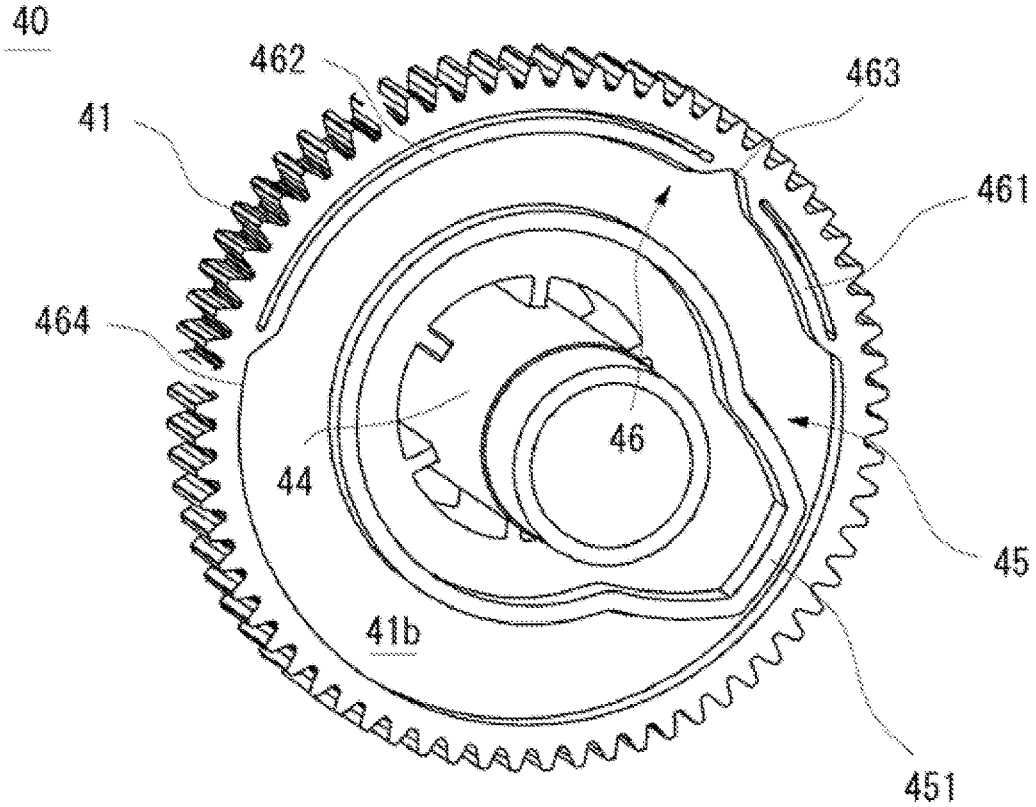

FIGS. 7A and 7B are perspective views showing a structure of the cam gear 40. FIG. 7A is a perspective view showing a front face side of the cam gear 40, and FIG. 7B is a perspective view showing a rear face side of the cam gear 40. As shown in FIG. 7A, the cam gear 40 is provided on its front face side with an ice making tray fitting shaft 42, which is a shaft part in a rectangular shape that is connected with a rear end part of the ice making tray 20, and a case fitted shaft 43 which is a circular shaft part that is supported by a bearing not shown provided in the case body 10.

As shown in FIG. 7B, a rear face side of the cam gear 40 is provided with a tube part 44 in a cylindrical tube shape at its center. A lowering stopping sleeve 49 described below is attached to an outer face of the tube part 44. The rear face 41*b* of the gear part 41 is formed with a first cam 45 and a second cam 46 which are ribs structuring a driver part of a plane cam mechanism. The first cam 45 is a rib formed in a substantially circular ring shape. The driven shaft 50 is turned along a shape of an inner peripheral face of the first cam 45. The first cam 45 is provided with a recessed slope 451 which is a slope stretched to an outer side in a radial direction in a predetermined range in a circumferential direction. The second cam 46 is a rib which is formed along a periphery of the rear face 41*b* of the gear part 41. The switch lever 72 is turned along a shape of an inner peripheral face of the second cam 46. The second cam 46 is provided with a former side protruded slope 461 and a latter side protruded slope 462, which are slopes on which the switch lever 72 rides, an intermediate recessed slope 463 which is a downward slope provided between the protruded slopes, and a terminal recessed slope 464 which is a downward slope continuing in a clockwise direction in the drawing from the latter side protruded slope 462.

Figure 8A:
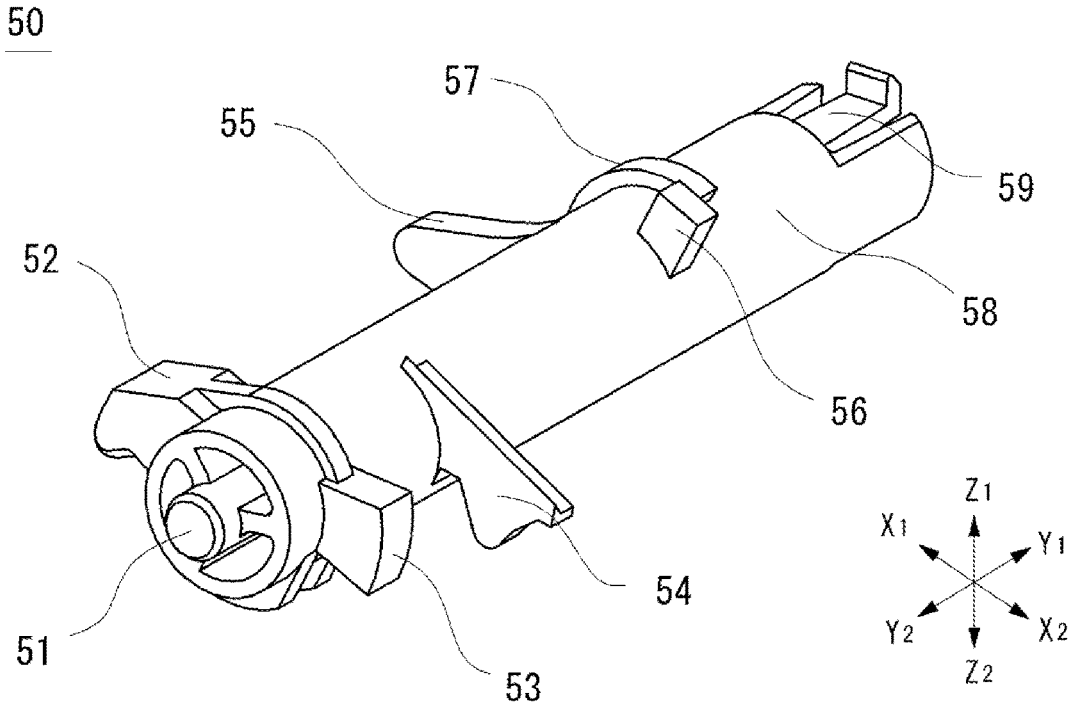
FIG. 8A is a perspective view showing a structure of a driven shaft and FIG. 8B is its side view.
Figure 8B:
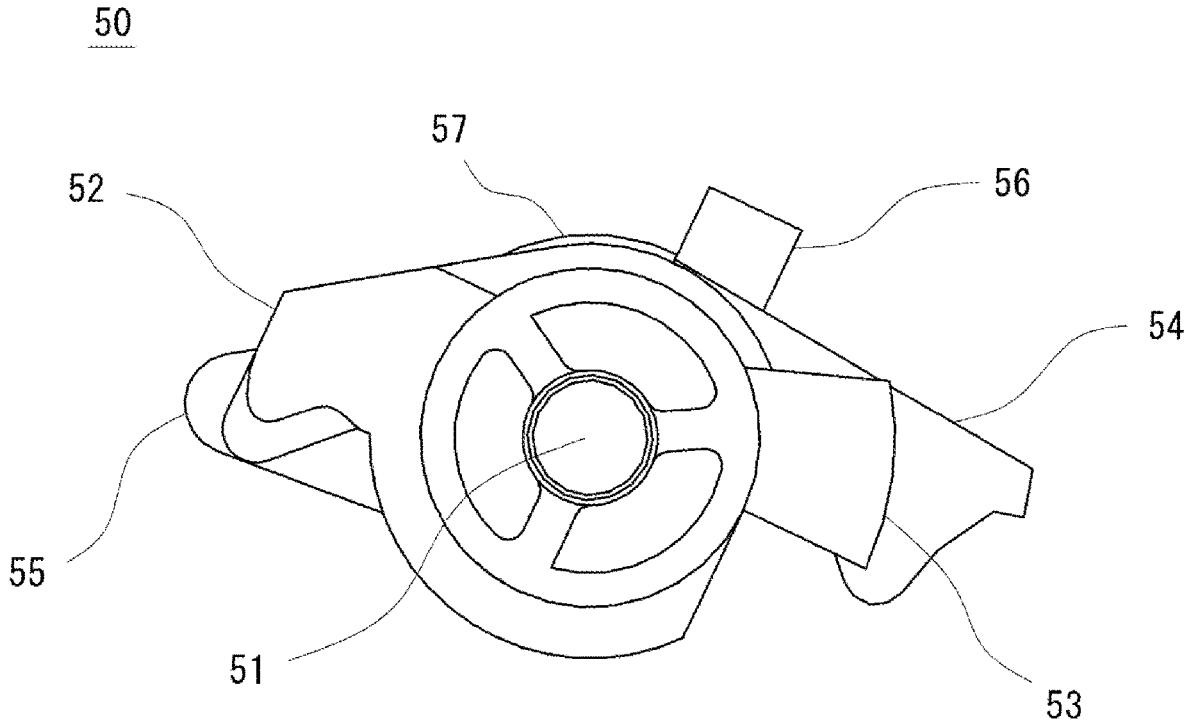

FIG. 8A is a perspective view showing a structure of the driven shaft 50 and FIG. 6B is its side view. The driven shaft 50 is provided with a tip end shaft 51 and an intermediate shaft 58 which are shaft parts supported by the box part 12 including the inner case 13. The driven shaft 50 is provided with a plurality of protruded parts on a body part in a columnar shape. These protruded parts are structured, from the "Y2" side toward the "Y1" side, of a sliding part 52 which is a cam follower contacting with the first cam 45, a turning stopping part 53 which is abutted with a lowering stopping sleeve 49 described below to prevent turning of the driven shaft 50 in the "CCW" direction in FIG. 8B, a spring receiving part 54 which is always urged toward an upper side (in other words, so as to turn the driven shaft 50 in the "CCW" direction) by a coil spring 541 (see FIG. 3), a first positioning piece 55 which is inserted into a recessed part (not shown) of the box part 12 to restrict a turning range of the driven shaft 50, a switch lever operation part 56 which is contacted with the switch lever 72 to operate a swing angle of the switch lever 72, and a second positioning piece 57 which is contacted with an inner face of the box part 12 to prevent movement of the driven shaft 50 in the "Y1" direction.

Figure 9A:
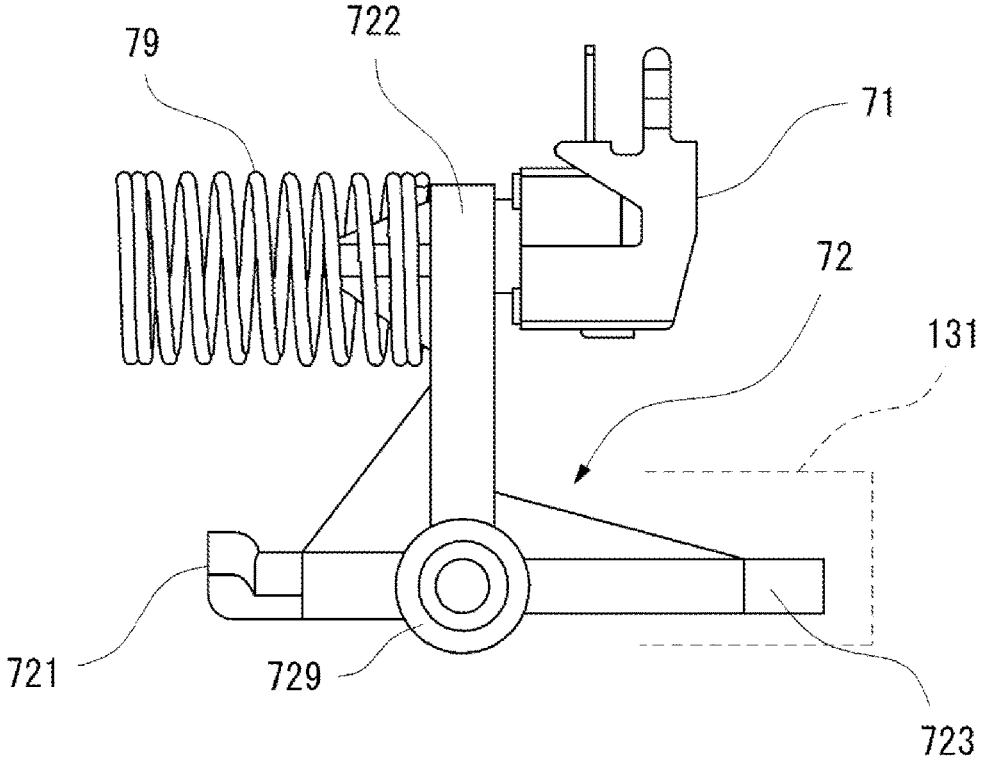
FIG. 9A is a plan view showing a structure of a switch lever and FIG. 9B is its perspective view.
Figure 9B:
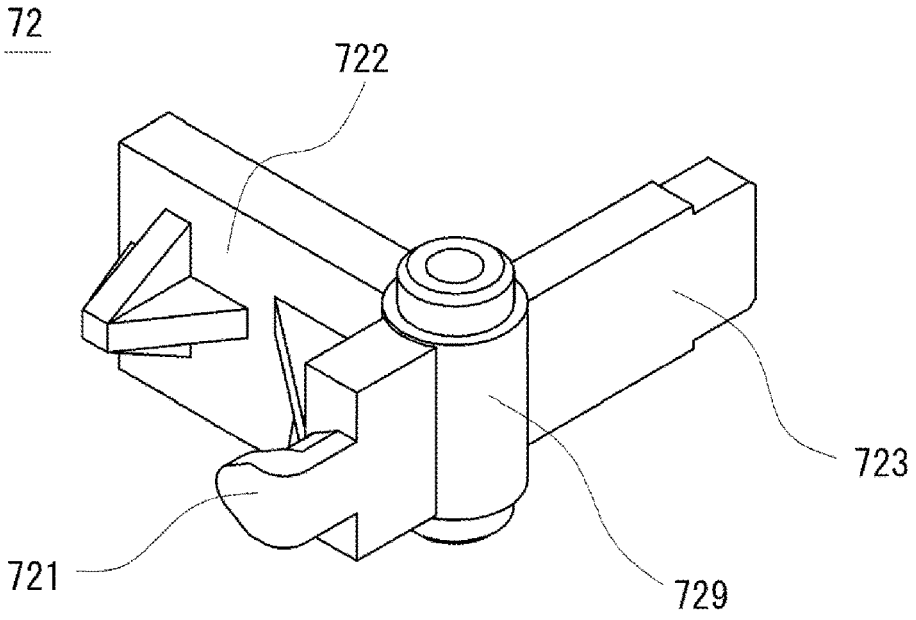

FIG. 9A is a plan view showing a structure of the switch lever 72 and FIG. 7B is its perspective view. The switch lever 72 is an arm-shaped member having a shaft part 729 which is a turning center, and a plurality of free ends which are turned with the shaft part 729 as a turning center. The switch lever 72 is, as the free end, provided with a sliding part 721 which is a cam follower contacting with the second cam 46, a switch operation part 722 which is always urged to a side of the ice detection switch 71 by a coil spring 79, and a turning restriction part 723 which is inserted into a recessed part 131 of the inner case to restrict a turning range of the switch lever 72.

(Detail of Ice Separating Operation)

The ice separating operation of the ice making device 90 will be described further in detail below with reference to FIGS. 10 through 14.

Figure 10:
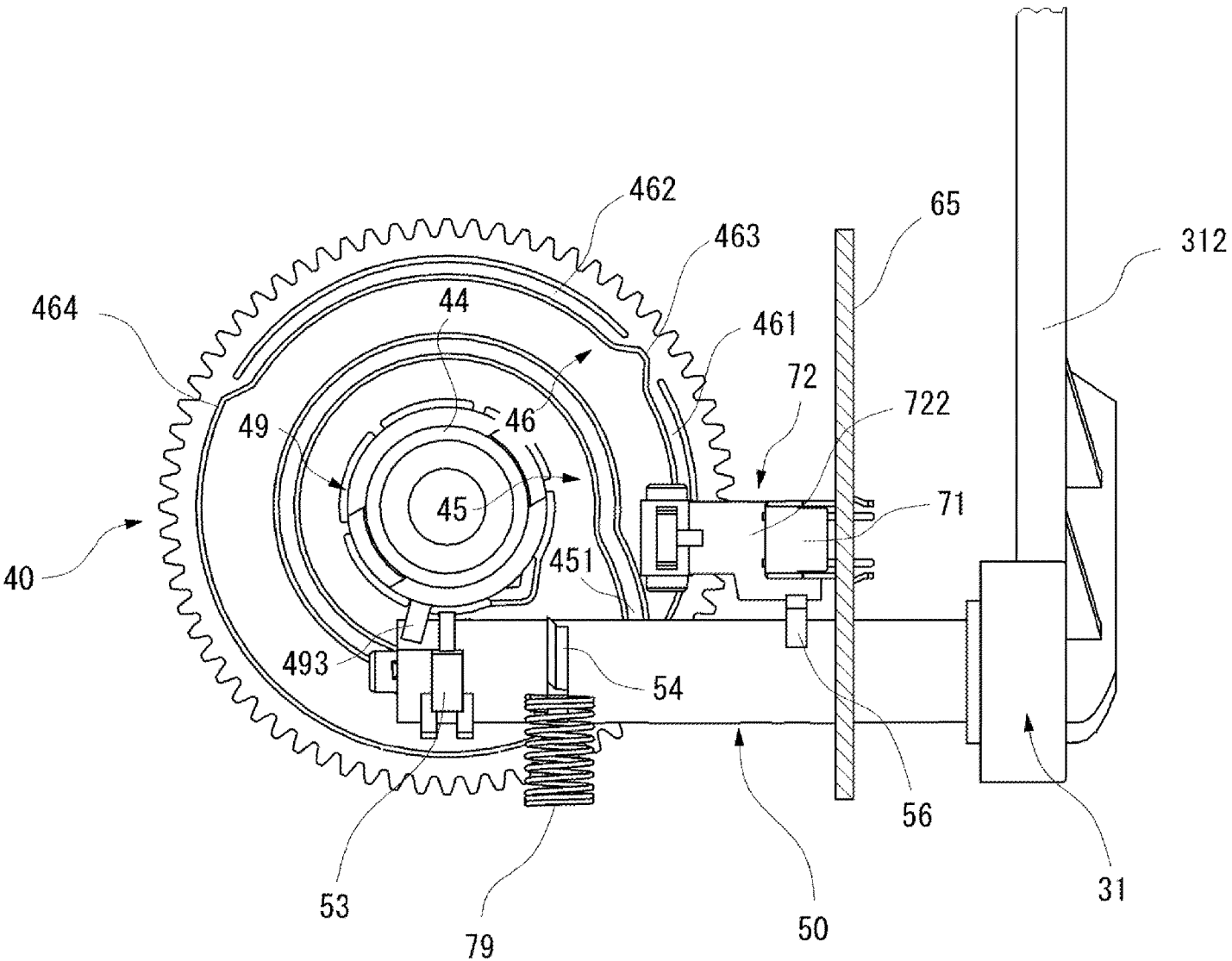
FIG. 10 is a rear view showing a state of a drive mechanism when an ice making tray is located at an ice making position.

FIG. 10 is a rear view showing the drive mechanism when the ice making tray 20 is located at an ice making position. In this state, the sliding part 52 of the driven shaft 50 is located outside the recessed slope 451 of the first cam 45 and thus, the ice detection lever 31 is raised upward. The sliding part 721 of the switch lever 72 does not ride on the former side protruded slope 461 yet and thus, the ice detection switch 71 is set in an "ON" state.

Figure 11A:
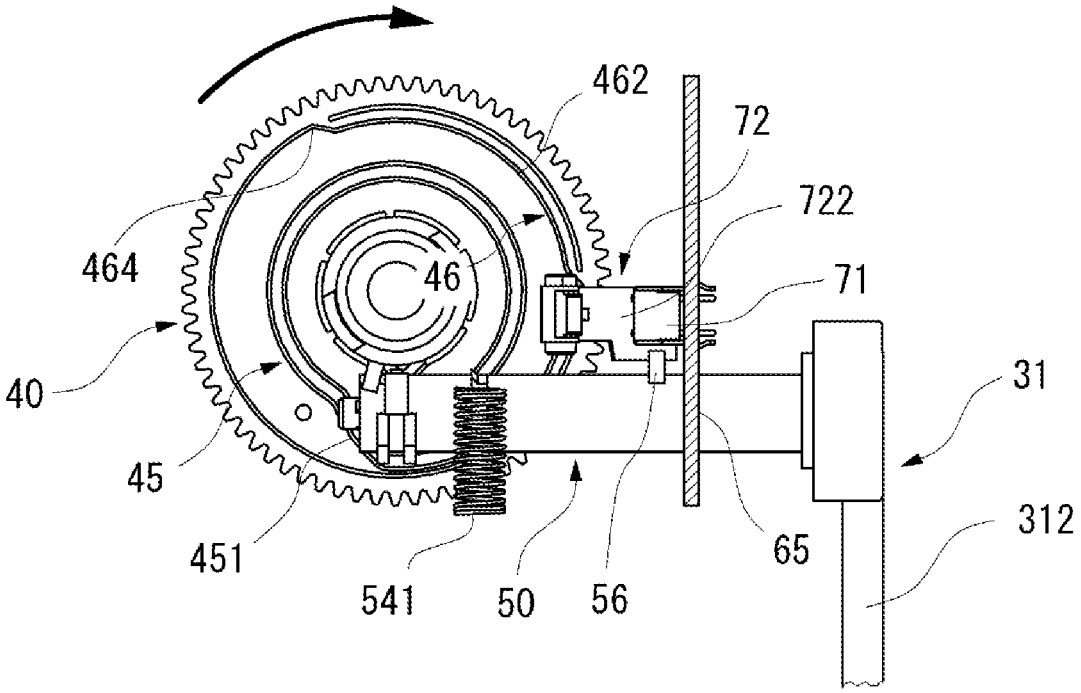
FIG. 11A is a rear view showing a state of a drive mechanism at a time of an ice detection operation and FIG. 11B is its side view.
Figure 11B:
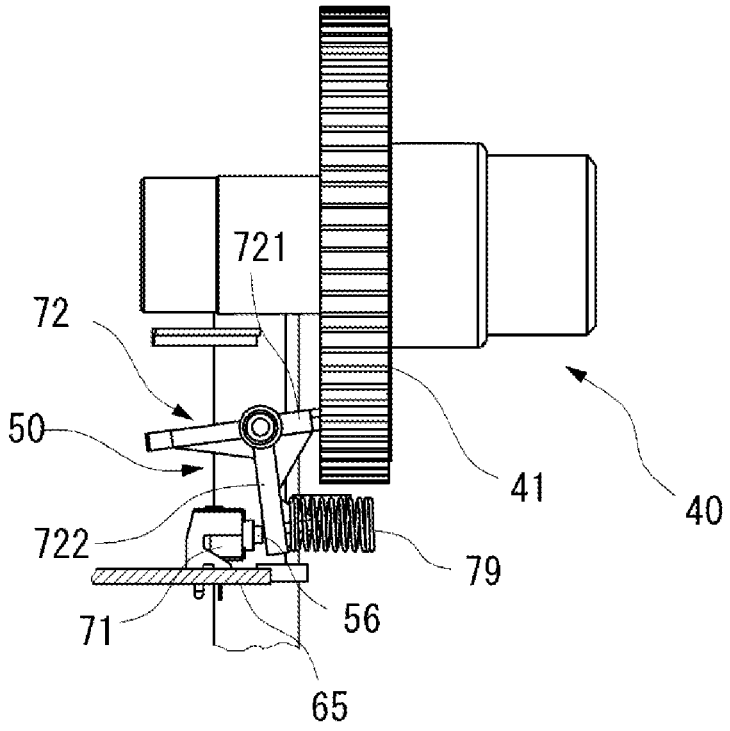
Figure 12:
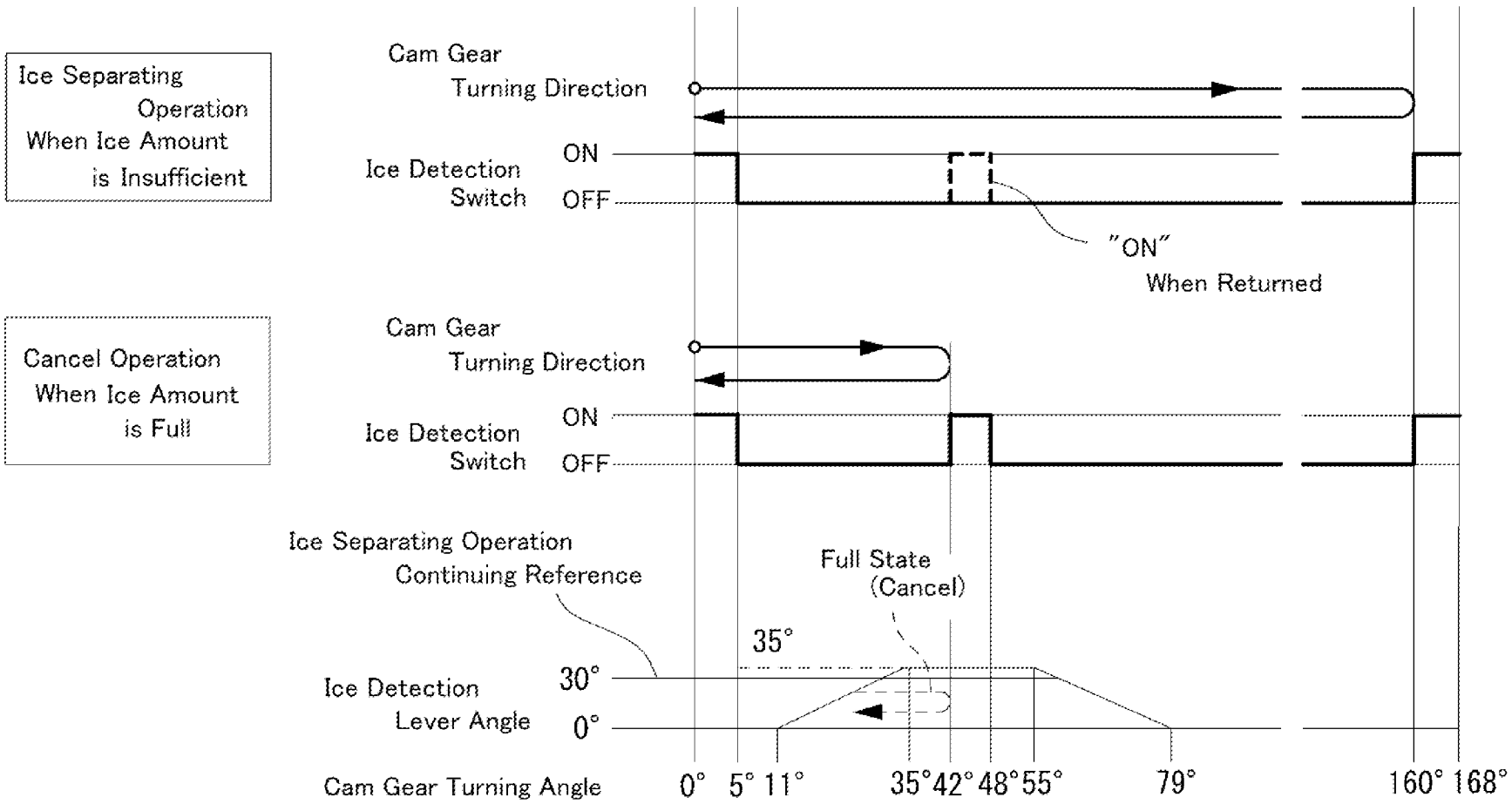
FIG. 12 is a timing chart showing operations of respective parts when an ice separating operation is continued and interrupted.

FIG. 11A is a rear view showing the drive mechanism when the ice detection operation is performed and FIG. 11B is its side view. FIG. 12 is a timing chart showing operations of respective parts when the ice separating operation is continued and canceled. When an ice separation preparatory operation has completed, the drive unit 91 turns the cam gear 40 in the "CW" direction in the drawing. As a result, the sliding part 52 of the driven shaft 50 enters the recessed slope 451 and the ice detection lever 31 is lowered. When the ice detection lever 31 starts to move downward, the sliding part 721 of the switch lever 72 simultaneously rides on the former side protruded slope 461 and the ice detection switch 71 is turned to an "OFF" state.

When a downward movement of the ice detection lever 31 is not prevented by ice pieces and the arm part 312 is turned more than 30°, and when a lifting and lowering part 313 is moved downward so as to exceed a reference level in an inside of the ice storage part 92, in other words, when the sliding part 52 of the driven shaft 50 has reached a deep part of the recessed slope 451, the switch lever operation part 56 of the driven shaft 50 is contacted with the switch operation part 722 of the switch lever 72 to press the switch operation part 722 in a direction separated from the ice detection switch 71. When the cam gear 40 is turned to a position where the sliding part 52 of the driven shaft 50 is located at the deep part of the recessed slope 451, the sliding part 721 of the switch lever 72 reaches a position of the intermediate recessed slope 463 of the second cam 46. In this case, when the ice detection lever 31 has been sufficiently lowered and a return of the switch operation part 722 of the switch lever 72 (return to the ice detection switch 71 side) is restricted by the switch lever operation part 56 of the driven shaft 50, the ice detection switch 71 is kept in the "OFF" state and the cam gear 40 continues turning in the "CW" direction.

In this embodiment, when a downward movement of the ice detection lever 31 is prevented by stored ice pieces and the driven shaft 50 is not turned sufficiently, the switch lever operation part 56 of the driven shaft 50 does not reach the switch operation part 722 of the second lever 72 and, as a result, the sliding part 721 of the switch lever 72 is moved along the intermediate recessed slope 463 to turn the ice detection switch 71 to an "ON" state. When the control device of the refrigerator detects that the ice detection switch 71 has been switched to the "ON" state within a predetermined time period, the control device cancels the ice separating operation and returns the ice making tray 20 to the ice making position without discharging ice pieces.

Figure 13:
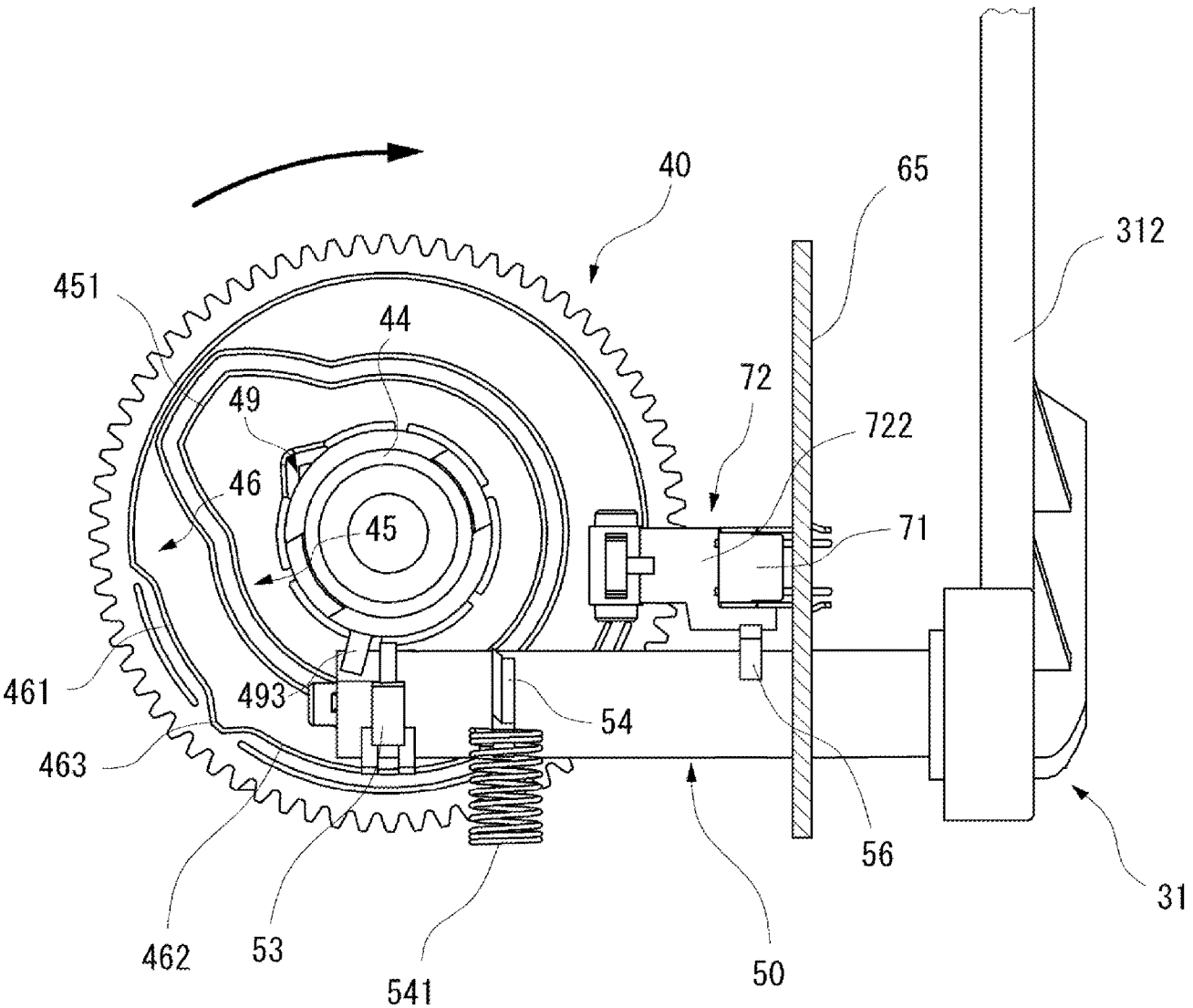
FIG. 13 is a rear view showing a drive mechanism at a time of a discharge operation.

FIG. 13 is a rear view showing the drive mechanism at the time of a discharge operation of ice pieces. When the ice detection switch 71 has passed through the intermediate recessed slope 463 while the ice detection switch 71 is kept in the "OFF" state, the sliding part 52 of the driven shaft 50 rides on the opposite side cam with respect to the recessed slope 451 and thereby, the ice detection lever 31 is moved upward. In this case, the sliding part 721 of the switch lever 72 has ridden on the latter side protruded slope 462 and thus, even when the switch lever operation part 56 of the driven shaft 50 does not press the switch operation part 722 of the switch lever 72, the ice detection switch 71 is kept in the "OFF" state. When the ice making tray 20 has been fully twisted in the "CW" direction in the drawing and the ice pieces has been discharged, the sliding part 721 of the switch lever 72 is moved to the terminal recessed slope 464 and the ice detection switch 71 is switched to an "ON" state. The refrigerator detects completion of discharge of the ice pieces based on the switching of the ice detection switch 71.

Figure 14:
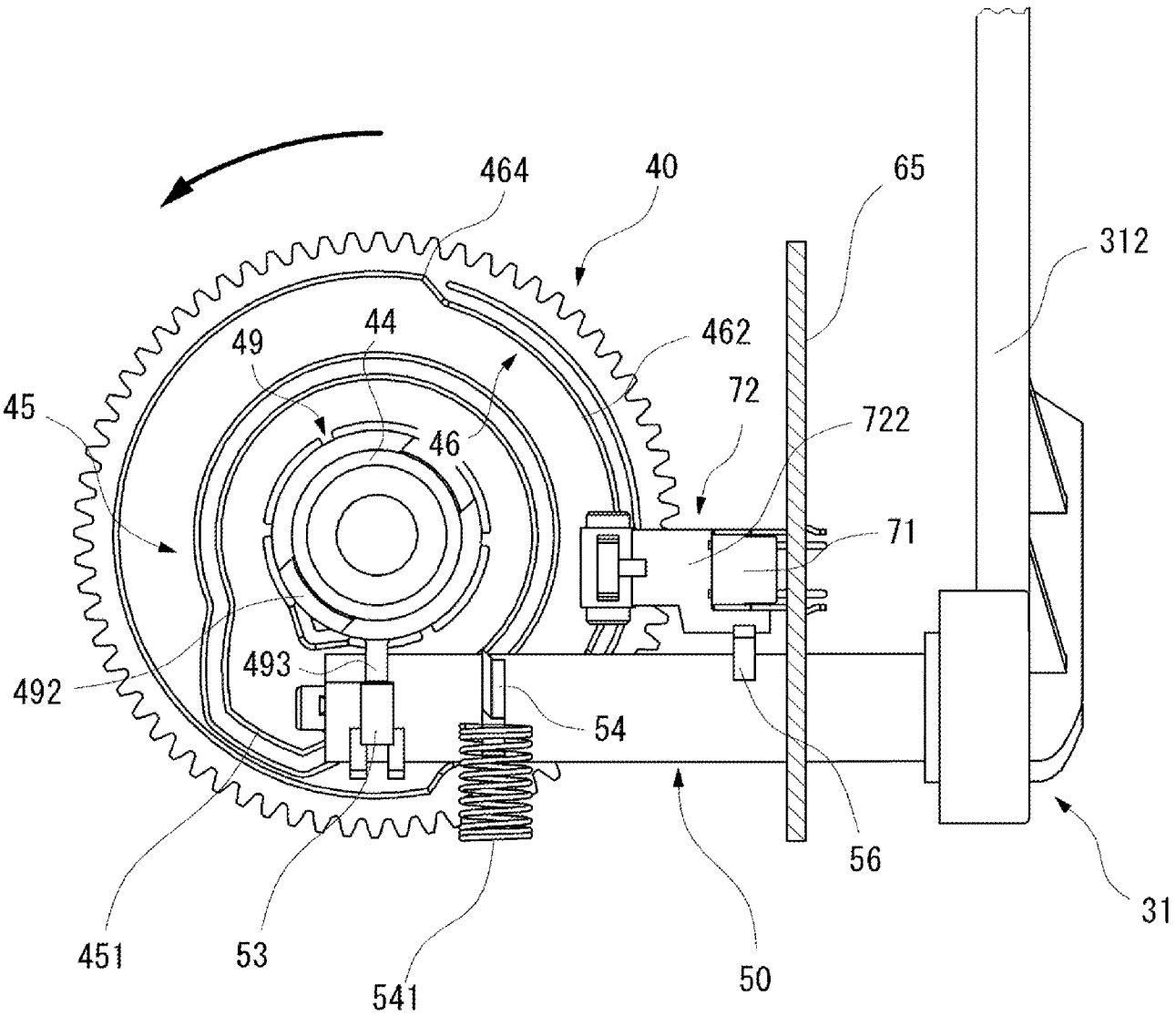
FIG. 14 is a rear view showing a drive mechanism after ice pieces have been discharged.

FIG. 14 is a rear view showing the drive mechanism after the ice pieces have been discharged. When discharge of the ice pieces has been finished, the ice making device 90 returns the ice making tray 20 to the ice making position. In this embodiment, the tube part 44 of the cam gear 40 is attached with the lowering stopping sleeve 49 in a cylindrical tube shape. The lowering stopping sleeve 49 is provided with a body part formed with a slit 492 and a protruded part 493 which is protruded to an outer side from the body part. The lowering stopping sleeve 49 is not fixed to the tube part 44 and is turned together with the tube part 44 by frictional resistance. A turning range of the protruded part 493 is restricted by the case body 11, and the protruded part 493 is reciprocated within the movable range in the turning direction of the cam gear 40. After the ice pieces have been discharged, when the cam gear 40 is turned in the "CCW" direction in the drawing, the sliding part 52 of the driven shaft 50 reaches the recessed slope 451 again. However, in this case, the turning stopping part 53 of the driven shaft 50 is abutted with the protruded part 493 of the lowering stopping sleeve 49 and the driven shaft 50 is prevented from being turned. Therefore, the ice detection lever 31 is not moved downward during the return operation.

Embodiments of the present invention may be structured as follows.

(1) An ice making device which includes:

an ice making tray;

an output part which is connected with the ice making tray and turns the ice making tray;

a motor which is a drive source of the output part;

a first board having a converter which converts alternating current (AC) to direct current (DC); and a second board connected with a part which is operated by DC, where the second board has a control part which controls an operation of the ice making device, and the first board and the second board are connected with each other by inter-board connectors.

(2) The ice making device described in the above-mentioned structure (1), where the inter-board connectors vertically connect the first board with the second board.

(3) The ice making device described in the above-mentioned structure (1) or (2), where no lead wire is used for connection of the first board with the second board.

(4) The ice making device described in one of the above-mentioned structures (1) through (3), where the motor is a DC motor, and the second board has a drive circuit for the motor.

(5) The ice making device described in one of the above-mentioned structures (1) through (4), further including an ice detection member which is lowered to an inside of an ice storage part where ice pieces discharged from the ice making tray are stored and detects an ice amount in the inside of the ice storage part, where the second board is connected with a switch or a sensor which detects a lowering amount of the ice detection member.

(6) The ice making device described in one of the above-mentioned structures (1) through (5), further including a temperature sensor which detects a temperature of water stored in the ice making tray, where the temperature sensor is connected with the second board.

(7) The ice making device described in one of the above-mentioned structures (1) through (6), where the first board has a relay which opens and closes a water supply valve for supplying water to the ice making tray.

(8) The ice making device described in one of the above-mentioned structures (1) through (7), where the first board has a varistor.

(9) The ice making device described in one of the above-mentioned structures (1) through (8), further including a case body which accommodates the first board and the second board, where the case body includes a first space which is a space where the first board is accommodated and a second space which is a space where the second board is accommodated in its inside, the first space and the second space are sectioned by a partition, and the partition is provided with an opening part for connecting the inter-board connectors with each other.

(10) The ice making device described in the above-mentioned structure (9), where the case body is provided with a frame part which turnably supports the ice making tray and a box part which accommodates the first board and the second board, the box part includes an inner case which is a half case body having no cover in its inside, the inner case is fixed to an inner face of the box part in a state that an opening of the inner case is directed toward the inner face of the box part, and the partition is the inner case.

(11) The ice making device described in the above-mentioned structure (10), where the box part includes a cover part which is capable of being attached and detached, the second board is connected with a main switch which is a switch for starting the ice making device, and each of the inner case and the cover part is provided with a hole through which the main switch is capable of being accessed from the outside of the cover part.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice making tray;

an output part which is connected with the ice making tray and turns the ice making tray;

a motor which is a drive source of the output part;

a first board having a converter which converts alternating current to direct current;

a second board connected with a part which is operated by the direct current; and a case body which accommodates the first board and the second board, wherein the second board comprises a control part which controls an operation of the ice making device; and the first board and the second board are connected with each other by inter-board connectors, wherein the case body comprises a frame part which turnably supports the ice making tray and a box part which accommodates the first board and the second board, wherein the box part comprises an inner case which is a half case body having no cover in an inside of the box part, wherein the box part comprises a cover part which is capable of being attached and detached, the second board is connected with a main switch which is a switch for starting the ice making device, and each of the inner case and the cover part comprises a hole through which the main switch is capable of being accessed from an outside of the cover part.

2. The ice making device according to claim 1, wherein the inter-board connectors vertically connect the first board with the second board.

3. The ice making device according to claim 1, wherein no lead wire is used for connection of the first board with the second board.

4. The ice making device according to claim 1, wherein the motor is a direct current motor, and the second board comprises a drive circuit for the motor.

5. The ice making device according to claim 1, further comprising an ice detection member which is lowered to an inside of an ice storage part where ice pieces discharged from the ice making tray are stored and detects an ice amount in the inside of the ice storage part, wherein the second board is connected with a switch or a sensor which detects a lowering amount of the ice detection member.

6. The ice making device according to claim 1, further comprising a temperature sensor which detects a temperature of water stored in the ice making tray, wherein the temperature sensor is connected with the second board.

7. The ice making device according to claim 1, wherein the first board comprises a relay which opens and closes a water supply valve for supplying water to the ice making tray.

8. The ice making device according to claim 1, wherein the first board comprises a varistor.

9. The ice making device according to claim 1, wherein the case body comprises a first space which is a space where the first board is accommodated and a second space which is a space where the second board is accommodated in its inside, the first space and the second space are sectioned by a partition, and the partition comprises an opening part for connecting the inter-board connectors with each other.

10. The ice making device according to claim 9, wherein the inner case is fixed to an inner face of the box part in a state that an opening of the inner case is directed toward the inner face of the box part, and the partition is the inner case.

* * * * *